US005928384A

United States Patent [19]

Scialla et al.

[11] Patent Number: 5,928,384

[45] **Date of Patent: *Jul. 27, 1999**

[54] METHOD OF CLEANING CARPETS

[75] Inventors: Stefano Scialla; Floriana Raso, both of Rome, Italy

[73] Assignee: The Procter & Gamble Company, Cincinnati, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/836,299

[22] PCT Filed: Oct. 31, 1995

[86] PCT No.: PCT/US95/13995

§ 371 Date: Aug. 7, 1997

§ 102(e) Date: Aug. 7, 1997

[87] PCT Pub. No.: WO96/15308

PCT Pub. Date: May 23, 1996

[30] Foreign Application Priority Data

Nov. 10, 1994 [EP] European Pat. Off. ..... 94870175

[51] Int. Cl.[6] ..... D06M 15/61; D06L 3/02; C11D 1/08

[52] U.S. Cl. ..... 8/137; 8/142; 8/111; 510/278; 510/279; 510/280

[58] Field of Search ..... 8/137, 142, 111; 510/278, 279, 280

[56] References Cited

U.S. PATENT DOCUMENTS

| | | | |
|---|---|---|---|
| 3,308,067 | 3/1967 | Diehl . | |
| 3,607,760 | 9/1971 | McIntyre . | |
| 3,723,323 | 3/1973 | Morgan . | |
| 3,779,929 | 12/1973 | Abler et al. | 510/279 |
| 3,812,044 | 5/1974 | Connor et al. . | |
| 4,648,882 | 3/1987 | Osberghaus et al. | 8/142 |
| 4,652,389 | 3/1987 | Moll | 510/279 |
| 4,689,167 | 8/1987 | Collins et al. | 510/299 |
| 4,704,233 | 11/1987 | Hartman et al. . | |
| 5,338,475 | 8/1994 | Corey et al. | 510/280 |
| 5,395,555 | 3/1995 | Colurciello et al. | 510/280 |

FOREIGN PATENT DOCUMENTS

| | | |
|---|---|---|
| 0 001 310 | 4/1979 | European Pat. Off. . |
| 0 066 915 A2 | 12/1982 | European Pat. Off. . |
| 0 346 835 B1 | 12/1989 | European Pat. Off. . |
| 0 629 694 A1 | 12/1994 | European Pat. Off. . |
| 1 234 320 | 6/1971 | United Kingdom . |
| 2 227 021 | 7/1990 | United Kingdom . |
| 92/17634 | 10/1992 | WIPO . |
| 94/09103 | 4/1994 | WIPO . |
| 94/11099 | 5/1994 | WIPO . |

OTHER PUBLICATIONS

Derwent Abstract No. 93–345671/44 for DE 4213036 A1, Oct. 1993.

*Primary Examiner*—Alan Diamond
*Attorney, Agent, or Firm*—Robert B. Aylor

[57] ABSTRACT

The present invention relates to the use of compositions comprising an organic chelator together with a soil suspending polycarboxylate or polyamine polymer for the cleaning of carpet. The compositions may be in liquid or granular form and they may also contain surfactants and oxygen bleaches.

18 Claims, No Drawings

METHOD OF CLEANING CARPETS

This application is a 371 of PCT/US95/13995 filed Oct. 31, 1995.

TECHNICAL FIELD

The present invention relates to the use of compositions for cleaning carpets.

BACKGROUND OF THE INVENTION

Carpets produced from synthetic or natural fibers and mixtures thereof are commonly used in residential and commercial applications as a floor covering. Various types of fibers can be used in making carpets such as polyamide and wool.

However, carpets irrespective of whether they are made from natural or synthetic fibers are all prone to soiling and staining when contacted with many household items. Foods, grease, oils, beverages such as coffee, tea and soft drinks especially those containing acidic dyes can cause unsightly, often dark stains on carpets. Also fibers may become soiled as a result of dirt particles, clay, dust, particulate soils in general, coming into contact with, and adhering to the fibers of the carpet. These latter soils often appear in the form of a diffuse layer of soils rather than in the form of spots and tend to accumulate particularly in the so called "high traffic areas" such as near doors as a result of intensive use of the carpets in such areas.

There are a number of carpet cleaning compositions described in the art for removing stains and soils. However, these compositions do not satisfactorily meet the consumer's needs as regards their cleaning performance on different types of stains and soils. Indeed, these carpet cleaner compositions are not fully satisfactory for removing particulate soils, especially in the so called "high traffic areas".

Thus the object of the present invention is to provide improved removal of particulate soils from carpets, in a manner which is applicable to a variety of carpet cleaning compositions, i.e. compositions being either in a liquid form or in a powder form or in a granular form.

It has now been found that the above object can be met by formulating compositions which comprise a chelant in combination with a soil suspending polycarboxylate or polyamine polymer. Indeed, such a composition allows to obtain excellent particulate soil removal performance especially on diffuse layers of stains and soils which occur in the so called "high traffic areas", i.e. on stains and soils which have become otherwise extremely difficult to remove. More particularly, it has been found that the use of a composition comprising a chelant, or a combination of chelants, together with a soil suspending polycarboxylate or polyamine polymer, or mixtures thereof, results in a synergistic effect on the removal of particulate soils from carpets. Furthermore, said combination of a chelant with a soil suspending polycarboxylate or polyamine polymer is particularly suitable to be used in aqueous carpet cleaning compositions which further comprise a source of active oxygen, thereby providing excellent particulate soil removal performance while delivering also good cleaning performance on other types of soils and stains like bleachable stains.

An advantage of the present invention is that it is applicable to all carpet types, especially delicate natural fibers and is also safe to all carpet dye types, particularly sensitive natural dyes used therein.

Another advantage of the present invention is that it may be applied directly on the carpet without causing damage to the carpet. In addition the cleaning action of the invention commences as soon as the carpet cleaning composition has been applied to the surface. Indeed, the use of the carpet cleaning composition of the present invention does not necessarily require rubbing or/and brushing of the carpet.

The following documents are representative of the prior art available on carpet cleaning compositions.

WO 92/17634 discloses a method for removing stains from carpet fibers which consists on applying an alkaline solution (pH=7 to 10.5) to said carpet, said solution resulting from mixing just prior use of a solution of a source of active oxygen with a solution of ammonium bicarbonate or carbonate and fluorinated alkyl sulfonic acid or its coordinated salt. This patent application nowhere mentions the use of any chelant or soil suspending polycarboxylate or polyamine polymer, let alone the benefit resulting from their combined use, in a composition for cleaning carpets, i.e. the improved particulate soil removing performance of said composition.

U.S. Pat. No. 3,607,760 discloses an aqueous carpet cleaner particularly suitable for removing pet stains, said carpet cleaner comprising hydrogen peroxide, hydrocarbon ether of ethylene or diethylene glycols, hydrocarbon monohydric alcohols and EDTA. No soil suspending polymer is disclosed.

EP-A-346 835 discloses an aqueous carpet cleaner at pH 7–12 comprising a water-soluble alcohol (C1–C5) and an oxidizing agent (hydrogen peroxide). No chelants, no soil suspending polymers are described.

European patent application 93870161.2 discloses the use of stable aqueous compositions comprising a source of active oxygen, having a pH of from 1 to 6, for the cleaning of carpets. More particularly this European patent application discloses that such compositions may further comprise from 1% to 7% by weight of the total composition of a builder system, e.g. aminopolyphosphonates. No soil suspending polymers are disclosed.

SUMMARY OF THE INVENTION

The present invention encompasses the use of a composition comprising a chelant, or a mixture thereof, in combination with a soil suspending polycarboxylate or polyamine polymer, or a mixture thereof, for the cleaning of carpets.

The present invention further encompasses a method of cleaning a carpet wherein a composition comprising a chelant in combination with a soil suspending polycarboxylate or polyamine polymer is applied to said carpet, wherein said carpet is is then optionally rubbed and/or brushed, and wherein said composition is then removed from said carpet.

All amounts, percentages and ratios are given by weight of the total composition in its neat form unless otherwise stated.

DETAILED DESCRIPTION OF THE INVENTION

The present invention encompasses the use of a composition comprising a chelant, or a mixture thereof, in combination with a soil suspending polycarboxylate or polyamine polymer, or a mixture thereof, for the cleaning of carpets, whereby the performance on particulate soil removal is improved. According to the present invention the compositions used may be either in a liquid form or in a granular form or in a powder form.

By "improved particulate soil removing performance" it is meant herein that the removal of particulate soils from carpets achieved by using a carpet cleaning composition comprising a chelant together with a soil suspending polycarboxylate or polyamine polymer is improved, as compared to the removal of particulate soils obtained by using said composition without any chelant and/or without any soil suspending polycarboxylate or polyamine polymer. More particularly, it has been unexpectedly found that a synergistic effect on particulate soil removing performance is associated with the combination of a chelant with a soil suspending polycarboxylate or polyamine polymer. By "particulate soil" it is meant herein any soils or stains of particulate nature that can be found on carpets, e.g. clay, dirt, dust, mud, concrete and the like.

According to the present invention, the compositions herein comprise, as a first essential component, a chelant or a mixture thereof. Suitable chelants for use herein include phosphonate chelants, amino carboxylate chelants, and polyfunctionally-substituted aromatic chelating agents.

Suitable phosphonate chelants herein include organic amino phosphonate compounds, such as amino alkylene poly (alkylene phosphonate), alkali metal ethane 1-hydroxy diphosphonates, nitrilo trimethylene phosphonates, ethylene diamine tetra methylene phosphonates, and diethylene triamine penta methylene phosphonates. The phosphonate compounds may be present either in their acid form or as salts of different cations on some or all of their acid functionalities. Preferred phosphonate chelants to be used herein are diethylene triamine penta methylene phosphonates. Such phosphonate chelants are commercially available from Monsanto under the trade name DEQUEST.

Suitable aminocarboxylate chelants for use herein include ethylenediaminetetracetates, N-hydroxyethylenediaminetriacetates, nitrilotriacetates, ethylenediamine tetrapoprionates, triethylenetetraaminehexacetates, diethylenetriaminepentaacetates, and ethanoldiglycerides, alkali metal, ammonium, and substituted ammonium salts thereof.

Suitable polyfunctionally-substituted aromatic chelating agents useful herein are described in U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

The compositions herein can comprise, in their neat form, from 0.01% to 5% by weight of the total composition of a chelant or a mixture thereof, preferably from 0.05% to 3% and more preferably from 0.1% to 1%.

The compositions herein comprise, as a second essential ingredient, a soil suspending polycarboxylate or polyamine polymer, or a mixture thereof.

Any soil suspending polycarboxylate polymer known to those skilled in the art can be employed according to the present invention such as homo- or co-polymeric polycarboxylic acids or their salts including polyacrylates and copolymers of maleic anhydride or/and acrylic acid and the like. Indeed, such soil suspending polycarboxylate polymers can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein of monomeric segments, containing no carboxylate radicals such as vinylmethyl ether, styrene, ethylene, etc. is suitable provided that such segments do not constitute more than about 40% by weight.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylic/maleic-based copolymers may also be used as a preferred soil suspending polycarboxylic polymer. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982. Particularly preferred is a copolymer of maleic / acrylic acid with an average molecular weight of about 70,000. Such copolymers are commercially available from BASF under the trade name SOKALAN CP5.

Any soil suspending polyamine polymer can be employed herein. Particularly suitable polyamine polymer for use herein are polymers having polyalkoxymoiety are alkoxylated polyamines. Such materials can conveniently be represented as molecules of the empirical structures with repeating units:

Amine form

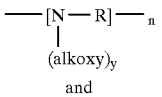

and

Quaternized form

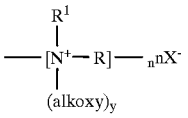

wherein R is a hydrocarbyl group, usually of 2–6 carbon atoms; $R^1$ may be a $C_1$–$C_{20}$ hydrocarbon; the alkoxy groups are ethoxy, propoxy, and the like, and y is 2–30, most preferably from 10–20; n is an integer of at least 2, preferably from 2–20, most preferably 3–5; and $X^-$ is an anion such as halide or methylsulfate, resulting from the quaternization reaction.

The most highly preferred polyamines for use herein are the so-called ethoxylated polyethylene amines, i.e., the polymerized reaction product of ethylene oxide with ethyleneimine, having the general formula

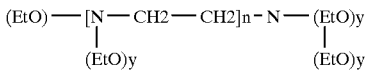

when y=2–30. Particularly preferred for use herein is an ethoxylated polyethylene amine, in particular ethoxylated tetraethylenepentamine, and quaternized ethoxylated hexamethylene diamine.

The compositions for the cleaning of carpets according to the present invention can comprise in their neat form of from 0.05% to 10% by weight of the total composition of a soil suspending polycarboxylate or polyamine polymer, or mixtures thereof, preferably of from 0.1% to 5%, more preferably of from 0.1% to 2% and most preferably of from 0.2% to 1.5%.

The concentrations mentioned herein for the soil suspending polycarboxylate or polyamine polymers and the chelants are preferred in that, at these concentrations, maximum performance is obtained in the most economic way. Also at these concentrations the amount of residues that the compositions may leave on carpets is minimal.

The present invention further encompasses the use, for the cleaning of carpets, of a composition which further comprise a source of active oxygen. In a preferred embodiment, said compositions are liquid aqueous compositions. The latter aqueous compositions being particularly efficient in terms of overall cleaning performance. Indeed, preferred compositions for the cleaning of carpets according to the present invention are particularly efficient in cleaning diffuse soils (particulate soils) that tend to accumulate in the so called "high traffic areas" but also in delivering good cleaning performance on other types of stains or soils, i.e. on spot stains such as coffee, beverage, food and the like.

Another advantage associated with the liquid aqueous compositions herein, when they comprise a source of active oxygen, is that said compositions are stable. Accordingly, said compositions are convenient for the consumer to use. Indeed, said liquid aqueous compositions for the cleaning of carpets according to the present invention do not require pH adjustment prior to use and can be stored for long periods of time prior to use.

Thus an optional but highly preferred ingredient of the compositions for the cleaning of carpets according to the present invention is a source of active oxygen. A preferred source according to the present invention is hydrogen peroxide or sources thereof. As used herein a hydrogen peroxide source refers to any compound which produces hydrogen peroxide when said compound is in contact with water. Suitable water-soluble sources of hydrogen peroxide for use herein include percarbonates, metal peroxides and perborates.

In addition other classes of peroxides can be used as an alternative to hydrogen peroxide and sources thereof or in combination with hydrogen peroxide and sources thereof. Suitable classes include dialkylperoxides, diacylperoxide, preformed percarboxylic acids, persulphates, organic and inorganic peroxides and/or hydroperoxides.

Accordingly, compositions herein comprise from 0.1% to 15%, preferably from 0.5% to 10%, most preferably from 1% to 5% by weight of the total composition of active oxygen in said composition.

As used herein, active oxygen concentration refers to the percentage concentration of elemental oxygen, with an oxidation number zero, that being reduced to water would be stoichiometrically equivalent to a given percentage concentration of a given peroxide compound, when the peroxide functionality of the peroxide compound is completely reduced to oxides. The active oxygen sources according to the present invention increase the ability of the compositions to remove colored stains, to destroy malodorous molecules and to kill germs.

The concentration of available oxygen can be determined by methods known in the art, such as the iodimetric method, the permanganometric method and the cerimetric method. Said methods and the criteria for the choice of the appropriate method are described for example in "Hydrogen Peroxide", W. C. Schumb, C. N. Satterfield and R. L. Wentworth, Reinhold Publishing Corporation, New York, 1955 and "Organic Peroxides", Daniel Swern, Editor Wiley Int. Science, 1970.

Suitable organic and inorganic peroxides/hydroperoxides for use in the compositions according to the present invention include diacyl and dialkyl peroxides/hydroperoxides such as dibenzoyl peroxide, t-butyl hydroperoxide, dilauroyl peroxide, dicumyl peroxide, persulphuric acid and mixtures thereof. The compositions according to the present invention comprise from 0% to 15%, preferably from 0.005% to 10% of said organic peroxides.

Suitable preformed peroxyacids for use in the compositions for the cleaning of carpets according to the present invention include diperoxydodecandioic acid DPDA, magnesium perphthalatic acid, perlauric acid, perbenzoic acid, diperoxyazelaic acid and mixtures thereof. The compositions for the cleaning of carpets according to the present invention comprise in their neat form from 0% to 15%, preferably from 0.005% to 10% of said preformed peroxyacids.

Optionally, the compositions herein may additionally comprise from 0% to 30%, preferably from 2% to 20% of peracid precursors, i.e. compounds that upon reaction with hydrogen peroxide produce peroxyacids. Examples of peracid precursors suitable for use in the present invention can be found among the classes of anhydrides, amides, imides and esters such as acetyl triethyl citrate (ATC), tetra acetyl ethylene diamine (TAED), succinic or maleic anhydrides.

The pH of the compositions herein can be from 1 to 14. In a preferred embodiment, wherein the compositions herein comprise a source of active oxygen, the recommended pH range to achieve good hydrogen peroxide stability is from 1 to 9, preferably between pH 1 and 8, and more preferably between pH 2 and 7. Accordingly the compositions herein may further comprise an acid to adjust pH. In addition, some acids can have the advantage that they can form small concentrations of the corresponding peracids by reaction with hydrogen peroxide in-situ, thus enhancing the overall performance of the composition. These acids can be further selected so as to have chelating and/or building properties. The acids of the present invention that may be used for these purposes can be organic or inorganic acids, preferably organic acids such as citric, maleic, oxalic succinic, and tartaric acids or inorganic acids such as sulphuric acid.

The compositions herein may further comprise a number of additional compounds such as surfactants, builder system, solvents, perfumes, dyes, suds suppressing agents, enzymes, photobleaching agents and other minors. In the preferred embodiment, where the compositions herein comprise a source of active oxygen, the optional ingredients are selected so that they are compatible with said source of active oxygen. For instance dyes are used at low concentrations to prevent staining. Solvents suitable for use herein may be selected from octyl alcohol, isopropyl alcohol, propyl alcohol and furfuryl alcohol.

Surfactants suitable for use herein are well known in the art and include anionic, nonionic, zwitterionic and cationic surfactants and mixtures thereof. The surfactants suitable for use herein are compatible with hydrogen peroxide and sources thereof.

The anionic surfactants which may be used herein include alkali metal salts of alkyl substituted benzene sulphonates, alkali metal alkyl sulphonates, alkali metal alkyl sulphates and alkali metal alkyl ether sulphates derived from for example fatty alcohols and alkyl phenols, alkali metal alkane sulphonates, alkali metal olefin sulphonates and alkali metal sulphosuccinates and alkyl succinates, whereby the sodium salts are preferred, alkyl carboxylates and alkyl ether carboxylates.

The nonionic surfactants which may be used herein include any liquid or solid ethoxylated $C_6$–$C_{24}$ fatty alcohol nonionic surfactant, alkyl propoxylates and mixtures thereof, fatty acid $C_6$–$C_{24}$ alkanolamides, $C_6$–$C_{20}$ polyethylglycol ethers, polyethylene glycol with molecular weight 1000 to 80000 and $C_6$–$C_{24}$ amine oxides, glucose amides, alkyl pyrrolidones, betaines.

Suitable cationic surfactants for use herein include quaternary ammonium compounds of the formula $R_1R_2R_3R_4N^+$ where $R_1$,$R_2$ and $R_3$ are methyl groups, and $R_4$ is a $C_{12-15}$ alkyl group, or where $R_1$ is an ethyl or hydroxy ethyl group, $R_2$ and $R_3$ are methyl groups and $R_4$ is a $C_{12-15}$ alkyl group.

Zwitterionic surfactants are also suitable optionals for use herein. Suitable zwitterionic surfactants include derivatives of aliphatic quaternary ammonium, phosphonium, and sulphonium compounds in which the aliphatic moiety can be straight or branched chain and wherein one of the aliphatic substituents contains from about 8 to about 24 carbon atoms and another substituent contains, at least, an anionic water-solubilizing group. Particularly preferred zwitterionic materials are the ethoxylated ammonium sulphonates and sulfates disclosed in U.S. Pat. No. 3,925,262, Laughlin et al., issued Dec. 9, 1975 and U.S. Pat. No. 3,929,678, Laughlin et al., issued Dec. 30, 1975. The compositions according to the present invention contain from 0% to 20% of zwitterionic surfactants.

The compositions herein comprise from 0.01% to 70% by weight, preferably from 0.1% to 50% by weight of the total composition of said surfactants.

The compositions herein may further comprise a builder system. Any conventional builder system is suitable for use herein. Suitable builders for use herein include citric acid, preferably in the form of a water-soluble salt, derivatives of succinic acid of the formula R_CH(COOH)$CH_2$(COOH) wherein R is $C_{10-20}$ alkyl or alkenyl, preferably $C_{12-16}$, or wherein R can be substituted with hydroxyl, sulpho sulphoxyl or sulphone substituents. Specific examples include lauryl succinate, myristyl succinate, palmityl succinate, 2-dodecenylsuccinate, 2-tetradecenyl succinate. Succinate builders are preferably used in the form of their water-soluble salts, including sodium, potassium, ammonium and alkanolammonium salts.

Other suitable builders are oxodisuccinates and mixtures of tartrate monosuccinic and tartrate disuccinic acid such as described in U.S. Pat. No. 4,663,071.

Further suitable builders for use herein are fatty acid builders including saturated or unsaturated $C_{10-18}$ fatty acids, as well as the corresponding soaps. Preferred saturated species have from 12 to 16 carbon atoms in the alkyl chain. The preferred unsaturated fatty acid is oleic acid.

A preferred builder system for use herein consists of a mixture of citric acid, fatty acids and succinic acid derivatives described herein above. The compositions herein preferably comprise from 0% to 10%, preferably from 1% to 7% by weight of the neat total composition of a builder system.

The present invention also encompasses a method of cleaning a carpet wherein a composition comprising a chelant in combination with with a soil suspending polycarboxylate or polyamine polymer is applied to said carpet, wherein said carpet is then optionally rubbed and/or brushed, and wherein said composition is then removed from said carpet.

Indeed, in the method of cleaning a carpet according to the present invention the step of applying a composition for the cleaning of carpets as described herein before, may be followed by a rubbing step or/and a brushing step. Preferably, the carpet may be cleaned by applying onto it a composition for the cleaning of carpets according to the present invention, then rubbing and/or brushing it more or less intensively for example by means of a sponge or a brush or other mechanical/eletrical device, optionally with the aid of water. In general the rubbing/brushing-times are between 0.1 to a few minutes per square meters. After the composition for the cleaning of carpets according to the present invention has been applied onto the carpet and said carpet has been rubbed or/and brushed, said composition is removed from said carpet, preferably by mechanical means including brushing out or/and vacuum cleaning.

The compositions for the cleaning of carpets according to the present invention may be applied to the carpet to be cleaned either in neat or diluted form, this applies to compositions being either liquid compositions or granular compositions or powder compositions.

By "diluted form" it is meant herein that the compositions for the cleaning of carpets as described herein before may be diluted by the user, preferably with water. Compositions herein can be diluted up to 150 times, preferably up to 50 times and more preferably up to 25 times.

In a preferred embodiment herein, the compositions for the cleaning of carpets according to the present invention are liquid aqueous compositions. Indeed, a liquid aqueous composition, i.e. an aqueous composition for the cleaning of carpets as described herein before in its neat form or which has been diluted with water by the user or an aqueous composition resulting from the dilution of a granular composition or of a powder composition, is applied to the carpet to be cleaned, said carpet is optionally rubbed and/or brushed, then said composition is left to dry and then removed from said carpet. Indeed, said liquid aqueous composition is left to dry until said composition which combined with dirt has been changed into dry residues. These residues are then removed from the carpet mechanically. Such liquid aqueous compositions may be applied directly onto the area to be treated or applied using a cloth or piece of material such as spraying device or aerosol can, a sponge, a brush or other mechanical/eletrical device. In a preferred embodiment of the invention a liquid aqueous composition is applied to the area to be treated by using a spraying device or an aerosol can. Such a spraying device may be trigger operated or pump operated or electrically operated or operated by any source of pressurized gas such as a can or a pressurizer. Such spraying devices are particularly preferable if a large area is to be treated as it facilitates the ease of use for the consumer. The spraying devices ensure uniform coverage of the area to be treated and maximizes the advantage of the using liquid aqueous compositions containing peroxides. This is because the application of product by spray best allows the product to be left to dry on the area treated, even without rubbing or brushing. This optimizes the action time of the composition and allows the best exploitation of the bleaching action of peroxides.

In another embodiment, the compositions for the cleaning of carpets according to the present invention are granular compositions or powder compositions. Such compositions for the cleaning of carpets according to the present invention may be applied directly onto the area of the carpet to be treated by for example sprinkling said composition over said area or may be applied by using a sponge, a brush, or other mechanical/eletrical device preferably in presence of water and then left to dry and then removed from said carpet.

The area to be treated using the compositions according to the present invention may be any size. In addition a complete section or even a whole carpet may be applied with the composition for the cleaning of carpets according to the present invention. For such purposes when using a liquid aqueous composition a spraying device with a pump to allow prolonged spraying is particularly useful.

The amount of the compositions for the cleaning of carpets according to the present invention applied will depend on the severity of the stain or soil. In the case of stubborn stains more than one application may be required to ensure complete removal of the stain. The carpet cleaning compositions may also be used in order to deodorize the carpet and remove the dinginess of the carpet resulting from a diffused layer of soil which results from general wear.

The compositions for the cleaning of carpets according to the present invention may be used both for manual carpet cleaning and carpet cleaning machines. For carpet cleaning machines the compositions for the cleaning of carpets according to the present invention, i.e. either liquid compositions or granular compositions or powder compositions, may be preferably diluted according to the machine operating instructions. Furthermore, compositions to be used in such machines should be formulated to prevent high sudsing. Preferably the ratio of nonionic surfactant to other surfactants should be higher. More preferably such compositions comprise suds suppressing agents.

According to the present invention the compositions may be used for the removal of odors, stains and soils from carpets or upholstery. In addition the compositions may be used to hygenise or disinfect carpets and exterminate micro-insects from the carpet or upholstery.

EXPERIMENTAL DATA

The following examples will illustrate the present invention. The compositions are made by combining the listed ingredients in the listed proportions (weight % unless otherwise specified).

| Compositions | 1 | 2 | 3 | 4 | 5 | 6 | 7 | 8 |
|---|---|---|---|---|---|---|---|---|
| Hydrogen peroxide | 7.0 | 7.0 | 7.0 | 7.0 | 7.0 | 7.0 | 7.0 | 7.0 |
| Na CnAS | 1.0 | 1.0 | 1.0 | 1.0 | 1.0 | 1.0 | 1.0 | 1.0 |
| Nonionic Surfactant | 1.0 | 1.0 | 1.0 | 1.0 | 1.0 | 1.0 | 1.0 | 1.0 |
| MA/AA | — | — | — | — | 1.0 | 2.0 | 1.0 | 1.0 |
| DETPMP | — | 0.2 | 1.0 | 2.0 | — | — | 0.2 | — |
| EDDS | — | — | — | — | — | — | — | 0.1 |
| Sulphuric acid | up to pH 6 | | | | | | | |
| Water | Balance | | | | | | | |

| Compositions | 9 | 10 | 11 | 12 |
|---|---|---|---|---|
| Hydrogen peroxide | 7.0 | 7.0 | 7.0 | 7.0 |
| Na CnAS | 1.0 | 1.0 | 1.0 | 1.0 |
| Nonionic Surfactant | 1.0 | 1.0 | 1.0 | 1.0 |
| MA/AA | 1.0 | 1.0 | 1.0 | 1.0 |
| PA | — | — | — | 1.0 |
| EDDS | 0.15 | 0.2 | — | — |
| DTPA | — | — | 0.1 | — |
| Sulphuric acid | up to pH 6 | | | |
| Water | Balance | | | |

DETPMP is diethylene triamine penta methylene phosphonic acid available from Monsanto under the trade name Dequest 2060 or Dequest 4060. MA/AA is copolymer of maleic/acrylic acid, average molecular weight about 70,000. PA is an ethoxylated tetraethylenepentamine, everage molecular weight about 70,000. EDDS is trisodium salt solution of [S,S]-Ethylenediamine-N,N'-disuccinic Acid. DTPA is pentasodium diethylenetriaminepentaacetate.

Composition 1 is taken as reference, i.e. it comprises no chelant and no soil suspending polycarboxylate or polyamine polymer. Compositions 2 to 4 comprise diethylene triamine penta methylene phosphonic acid, respectively, at different levels. Compositions 4, 5 and 6 comprise a copolymer of maleic/acrylic acid as the soil suspending polycarboxylate polymer of the present invention, at different levels. Composition 7 is representative of the compositions for the cleaning of carpets according to the present invention and comprises diethylene triamine penta methylene phosphonic acid together with a copolymer of maleic/acrylic acid. Compositions 8, 9 and 10 comprise a copolymer of maleic/acrylic acid as the soil suspending polycarboxylate polymer, and a non phosphonate chelant (EDDS) at different levels. Composition 11 comprises a copolymer of maleic/acrylic acid as the soil suspending polycarboxylate polymer, and a non phosphonate chelant (DTPA). Compositions 12 comprises ethoxylated tetraethylenepentamine as the soil suspending polyamine of the present invention.

An experiment was carried out with these compositions, using artificially soiled carpet samples commercially available from "WFK—Testgewebe GmbH", Broggen—Bracht, Germany.

20 ml of each of the compositions 1 to 7 was sprayed separately onto an artificial soiled carpet sample (40 cm×40 cm) with a trigger sprayer. All the resulting samples were left to dry for about 2 hours and then vacuum cleaned.

The samples were graded using a 0 to 4 evaluation scale. Composition 1 was taken as a reference and compared to compositions 2 to 7, to evaluate their particulate soil removing performance. Then composition 7 was taken as a reference to grade compositions 8 to 16. A composition graded 0 is a composition for which no difference was observed versus the reference composition (composition 1). A composition graded 4 is a composition for which a very large difference was observed versus the reference composition, i.e. important particulate soil removal was observed. The results in the following table are average results over 3 replicates test and on observations of 2 persons.
Results were as follows:

| Compositions | 1 | 2 | 3 | 4 | 5 | 6 | 7 |
|---|---|---|---|---|---|---|---|
| (psu) | ref. | 1.0 | 1.0 | 0.9 | 1.0 | 1.0 | 3.5 |

| Compositions | 7 | 8 | 9 | 10 | 11 | 12 |
|---|---|---|---|---|---|---|
| (psu) | ref | 2 | 0 | 1.25 | 0.5 | 0.75 |

The above results show the benefits obtained with a composition according to the present invention (Composition 7,8,9,10,11). Clearly, when using either only a chelant or only a soil suspending polycarboxylate or polyamine polymer, a plateau concentration value is reached and, beyond this concentration, no further improvement is observed. It has now unexpectedly been found that by combining a chelant together with a soil suspending polycarboxylate or polyamine polymer, a considerable performance improvement, well beyond what can be obtained using each of these ingredients singularly in the same composition, is achieved. Indeed, the results show that there is a synergistic effect associated with the use of a carpet cleaning composition comprising a chelant together with a soil suspending polycarboxylate or polyamine polymer. This synergistic effect is even stronger with a combination of chelants and a polyamine polymer in terms of particulate soil removing performance. In fact, particulate soil removal is observed even immediatelly after application, even before vacuum cleaning.

Additional Examples

| Compositions | 1 | 2 | 3 | 4 |
|---|---|---|---|---|
| Hydrogen peroxide | 6 | 6 | 7 | 7 |
| Na CnAS | 0.5 | 0.5 | — | — |
| Dobanol$^R$ 45-7 | 1 | — | 6.5 | 6 |
| Dobanol$^R$ 23-3 | — | — | 8 | 7 |
| MA/AA | 1.5 | 1 | 1 | 1.5 |
| DETPMP | 0.2 | 0.3 | 0.2 | 0.2 |
| PA | — | — | — | — |
| Acetyl triethyl citrate | — | — | 7 | 3.5 |
| Citric acid | — | — | 0.3 | 0.3 |
| Isopropyl alcohol | — | 5 | — | — |
| Water and minors | | Balance | | |
| PH | 6 | 6 | 4 | 4 |

DETPMP is diethylene triamine penta methylene phosphonic acid available from Monsanto under the trade name Dequest 2060 or Dequest 4060. MA/AA is copolymer of maleic/acrylic acid, average molecular weight about 70,000. PA is an ethoxylated tetraethylenepentamine, everage molecular weight about 70,000. EDDS is trisodium salt solution of [S,S]-Ethylenediamine-N,N'-disuccinic Acid.

The compositions in the examples are compositions for the cleaning of carpets according to the present invention, i.e. they exhibit excellent particulate soil removing performance while providing also good cleaning performance on other types of soils such as coffee, beverages and the like.

Compositions 1 and 2 are preferably used in manual carpet cleaning applications. Compositions 3 and 4 are preferably used in carpet cleaning machines. Compositions 5 and 6 can be used for both application, diluted if used in carpet cleaning machines.

Compositions 3 and 4 are prepared by mixing together separately all the water soluble ingredients on one hand, and all the water insoluble ingredients on the other hand, as follows: Premix 1 is Water, $H_2O_2$, Dob. 45-7, citric acid, MA/AA and DETPMP, and Premix 2 is Dob. 23-2, Acetyl triethyl citrate. Premix 1 is then poured into premix 2 (or viceversa) and vigorously stirred until a stable emulsion is obtained, typically for 30 minutes to 1 hour.

What is claimed is:

1. A method of cleaning a carpet wherein a composition comprising 0.01% to 3% by weight of an organic phosphonate chelant in combination with from 0.05% to 10% by weight of a soil suspending polycarboxylate selected from the group consisting of polyacrylic acid, a copolymer of acrylic acid and maleic acid and salts thereof, a soil suspending alkoxylated polyamine polymer, or a mixture thereof is applied to said carpet, wherein said carpet is then rubbed, and/or brushed, and wherein said composition is then removed from said carpet.

2. A method according to claim 1 wherein said composition is removed from said carpet by mechanical means comprising brushing out or/and vacuum cleaning.

3. The method according to claim 1 wherein said composition is a liquid aqueous composition applied neat or diluted to said carpet.

4. The method according to claim 3 wherein said composition is applied to said carpet, said carpet is rubbed or/and brushed, then said composition is left to dry before being removed from said carpet.

5. The method according to claim 4 wherein said composition is used in carpet cleaning machines.

6. The method according to claim 4 wherein said composition is applied to said carpet by means of a spraying device or an aerosol can.

7. The method according to claim 1 wherein said composition is a granular composition or a powder composition.

8. The method according to claim 1 wherein said composition comprises from 0.1% to 5% by weight of the total composition of said soil suspending polycarboxylate or polyamine polymer.

9. The method according to claim 8 wherein said composition comprises from 0.2% to 1.5% by weight of the total composition of said soil suspending polycarboxylate or polyamine polymer.

10. The method according to claim 1 wherein said organic phosphonate chelant is selected from the group consisting of amino alkylene poly (alkylene phosphonate), alkali metal ethane 1-hydroxy diphosphonates, nitrilo trimethylene phosphonates, ethylene diamine tetra methylene phosphonates, and diethylene triamine penta methylene phosphonates.

11. The method according to claim 10 wherein said chelant is diethylene triamine penta methylene phosphonate.

12. The method according to claim 1 wherein said soil suspending polycarboxylate copolymer is the copolymer of acrylic acid and maleic acid or salt thereof, wherein the number ratio of acrylate to maleate monomers ranges from 30:1 to 1:1 with an average molecular weight of from 2000 to 100000.

13. The method according to claim 1 wherein said soil suspending polyamine polymer is an ethoxylated polyethylene polyamine, or its quaternary salt.

14. The method according to claim 1 wherein said composition in its neat form further comprises a source of active oxygen.

15. The method according to claim 14 wherein said source of active oxygen is hydrogen peroxide.

16. The method according to claim 14 wherein said composition has a pH of from 1 to 9.

17. The method according to claim 1 wherein said composition comprises of from 0.05% to 3% by weight of the total composition of said chelant.

18. The method according to claim 17 wherein said composition comprises of from 0.1% to about 1% by weight of the total composition of said chelant.

* * * * *